US008813284B2

(12) United States Patent
Teasdale et al.

(10) Patent No.: US 8,813,284 B2
(45) Date of Patent: Aug. 26, 2014

(54) INFLATABLE COMPONENT FOR AN ALTERNATING PRESSURE MATTRESS

(76) Inventors: Barry Charles Teasdale, Cheshire (GB); Jon Lewis, Cardiff (GB)

( * ) Notice: Subject to any disclaimer, the term of this patent is extended or adjusted under 35 U.S.C. 154(b) by 0 days.

(21) Appl. No.: 11/884,424

(22) PCT Filed: Feb. 16, 2006 (Under 37 CFR 1.47)

(86) PCT No.: PCT/GB2006/000531
§ 371 (c)(1), (2), (4) Date: Nov. 25, 2008

(87) PCT Pub. No.: WO2006/087545
PCT Pub. Date: Aug. 24, 2006

(65) Prior Publication Data

US 2009/0211033 A1 Aug. 27, 2009

(30) Foreign Application Priority Data

Feb. 16, 2005 (GB) ..... 0503159.6

(51) Int. Cl.
*A47C 27/10* (2006.01)
*A47C 27/08* (2006.01)

(52) U.S. Cl.
USPC ..... 5/713; 5/710; 5/709

(58) Field of Classification Search
USPC ..... 5/713, 710, 706, 644, 654, 655.3, 709
See application file for complete search history.

(56) References Cited

U.S. PATENT DOCUMENTS 2,998,817 A * 9/1961 Armstrong ..... 601/149
3,192,540 A * 7/1965 Swank ..... 5/655.3
4,347,633 A * 9/1982 Gammons et al. ..... 5/713
4,472,847 A * 9/1984 Gammons et al. ..... 5/713
4,803,744 A * 2/1989 Peck et al. ..... 5/713
4,896,389 A * 1/1990 Chamberland ..... 5/710
4,947,500 A * 8/1990 Seiler ..... 5/713
5,010,608 A * 4/1991 Barnett et al. ..... 5/713
5,022,109 A * 6/1991 Pekar ..... 5/706
5,263,211 A 11/1993 Grant
5,539,942 A * 7/1996 Melou ..... 5/655.3
5,638,565 A * 6/1997 Pekar ..... 5/710
5,647,078 A * 7/1997 Pekar ..... 5/706
5,963,997 A * 10/1999 Hagopian ..... 5/654
6,006,383 A 12/1999 Pile et al.
6,302,988 B1 10/2001 Miller, Sr.
7,681,269 B2 * 3/2010 Biggie et al. ..... 5/715
2007/0143928 A1 * 6/2007 Biggie et al. ..... 5/715
2009/0211033 A1 * 8/2009 Teasdale et al. ..... 5/709

FOREIGN PATENT DOCUMENTS

EP 0 094 594 A 11/1983
WO WO 2004/058007 A 7/2004

* cited by examiner

*Primary Examiner* — Robert G Santos

(74) *Attorney, Agent, or Firm* — Amster, Rothstein & Ebenstein LLP

(57) ABSTRACT

An inflatable component (4) for an alternating pressure mattress (1). The inflatable component has at least two inflatable cells (15). Each cell (15) has at least two opposite edges (23, 24) and at least part of one of two opposite edges is free and lies within an outer peripheral edge of the component. The inflatable component (4) may be formed from two layers of material joined together along predetermined lines to define the cells. The inflatable component may include two or more groups of cells, each connected to a respective air inlet (19, 20). The inflatable component may be comprised in a mattress.

19 Claims, 2 Drawing Sheets

INFLATABLE COMPONENT FOR AN ALTERNATING PRESSURE MATTRESS

This is a U.S. national phase of PCT Application No. PCT/GB2006/000531 filed Feb. 16, 2006, which claims priority to GB Application No. 0503159.6, filed Feb. 16, 2005.

BACKGROUND OF THE INVENTION

The invention relates to an inflatable component for an alternating pressure mattress particularly, but not exclusively, for use in the prevention and relief of decubitus ulcers. The invention also relates to a method of manufacture of an inflatable component for an alternating pressure mattress.

Decubitus ulcers (or bed sores) are the result of restriction of blood flow through tissue by prolonged periods of pressure on a particular area of the body. Such pressure can be caused by lying in one position for a long period of time. Whereas a healthy person will respond to discomfort caused by pressure and move into a different position an unwell person is often unable to do this and so remains in the same position sufficient to cause decubitus ulcers.

The areas most commonly affected by prolonged periods of pressure are those where blood pressure is the lowest. This occurs at capillary interchanges where arterial flow becomes venal flow and the situation is often made worse by low blood pressure, low blood volume, mobility problems etc. (intrinsic factors), and high pressure points, caused by a too soft or too firm mattress, the result being greater pressure on prominent areas of the body (extrinsic factors).

Conventionally, methods used to prevent sores have included mobilising and manipulating the patient, using soft aids (mattress overlays, supports, pillows etc.), static pressure relieving mattresses (foam) and dynamic mattresses.

Depending on the assessed risk level of the patient succumbing to bed sores, different pressure relieving aids are available for use, high risk patients often being treated on a dynamic mattress. Such a system often involves the use of an inflatable component, with alternatively inflating and deflating cells to create varying high/low contact pressure on each part of the body.

Such inflatable components can be provided either as an overlay for an existing mattress or to form a replacement mattress, the former typically being less effective for a patient and the latter being expensive.

The preferred choice of the two is the replacement mattress. However, the associated expense often means that a hospital cannot provide one on each bed. Changes in the risk factor of each patient suffering from or developing decubitus ulcers then results in the available mattresses being moved from patient to patient, which is undesirable.

Problems with overlaying inflatable components include an uncomfortable undulating motion, gradual movement of the patient in one direction (peristaltic effect) and shrinking of the inflatable component on inflation.

U.S. Pat. No. 6,302,988 discloses an overlaying inflatable mattress with an air compartment layer having discrete air cells along the width of the mattress, with every other cell being linked to a common air supply for inflation, and outlets for deflation. The cells are created by the attachment of individual pieces of material across the width of a base sheet.

This arrangement addresses the problem of shrinkage on inflation. However, making the mattress is labour intensive and resultantly potentially expensive.

An object of embodiments of the present invention is to provide a low cost inflatable component for an air mattress which can be used interchangeably as a static or dynamic system and which improves on currently available systems.

SUMMARY OF THE INVENTION

According to one aspect of the invention therefore there is provided an inflatable component for an alternating pressure mattress comprising at least two inflatable cells, each cell having at least two opposite edges, at least part of one of the two opposite edges being free, the free edge lying within an outer peripheral edge of the component.

With this arrangement, when the cells are inflated, the free edges of the cells allow for movement of those edges within the component, thus reducing overall shrinkage of the component on inflation. The cells are still attached to the remainder of the component by the opposite edge. This reduction of shrinkage reduces unwanted movement of a patient supported on the mattress, yet can be achieved at lower cost than by provision of discrete cells, such as in U.S. Pat. No. 6,006,383.

The component may be formed from two overlying layers of material.

According to a second aspect of the invention therefore there is provided a method for making an inflatable component for an alternating pressure mattress comprising the steps of:

providing two overlying layers of material;

joining the two layers of material together along predetermined lines to define a plurality of individual inflatable cells, each having at least two opposite edges; and cutting through the two layers of material along at least part of the periphery of one of the opposite edges of each cell to provide each cell with a free edge lying within an outer peripheral edge of the component.

The layers of material are preferably formed by layers of sheet material, particularly a plastics sheet material.

Preferably, the inflatable component comprises a base layer and a top layer and these are preferably joined together along predetermined lines to define peripheral edges of the inflatable cells. This can be done by any method including using adhesive, heat welding, RF welding and the like. Most preferably, a heat stamping apparatus is used to provide a pattern of lines joining the two layers together.

Preferably, the cells are elongate in shape spanning the width of the component and are arranged laterally along at least a proportion of the length of the component. The cells may be of equal width or may vary in width along the length of the component and the varying widths of the cells may correspond to different areas of the body.

The free edge of each cell may comprise at least substantially all of one of its two opposite edges, with the remaining opposite edge being attached to the remainder of the component. The opposite edges of each cell are preferably generally parallel. In one embodiment each cell is generally rectangular with one of its long edges being free. More preferably one of its long edges and all or part of its short edges are free.

The cells may be arranged side by side adjacent each other, or they may be spaced apart. In one arrangement the cells are interspersed with compartments formed by the two layers of material, and which may span the width of the component. These compartments may be non-inflatable and may be narrower in width than the cells.

Each cell is preferably provided with an air inlet to allow for inflation and deflation of the cell. Preferably the component comprises at least two alternating groups of at least two cells, the cells of each group being connected to a common air inlet to allow for simultaneous inflation or deflation of the group of cells.

Air conduits leading to each cell or group of cells may be provided in the component by joining the two layers of material together to define conduits or channels. A material may be disposed in the channels to hold them open to facilitate passage of air therethrough. Where the cells are provided in at least two alternating groups a respective air conduit preferably communicates with the cells of each group.

In one embodiment cells forming two groups alternate along the length of the component, each cell extending laterally across the component. A first conduit having an air inlet extends along one lateral edge of the component, communicating with each cell from one group of cells and a second conduit having an air inlet extends along the opposite lateral edge of the component and communicates with each cell from the other group of cells.

An air supply, such as that used with conventional alternating pressure mattress can then be used to alternately inflate and deflate each group of cells via its associated air conduit.

The component may be used together with a base component (base) and a top component (top). The base may comprise a firm mattress and the top component may comprise a 2:1 ratio of firm:soft mattress material, the soft component being on the upper side of the top component in use. The inflatable component is most preferably provided between the base component and the top component. The base, the inflatable component and the top component may be enveloped in a mattress cover.

Where a top component and/or a base component is provided with an inflatable component the resulting mattress can be used in at least two modes: a static mode where the inflatable component is deflated and a dynamic mode wherein an air supply is connected to the inflatable component and operated to cause alternative inflation/deflation of the cells. The base and/or top components may be formed from a plastics foam material.

According to another aspect of the invention therefore there is provided a mattress comprising a layer of supportive material and an inflatable component.

BRIEF DESCRIPTION OF THE DRAWINGS

In order that it may be more clearly understood the invention will now be described further, by way of example only, with reference to the accompanying drawings in which.

DETAILED DESCRIPTION OF THE EXAMPLE EMBODIMENTS

Figure 1:
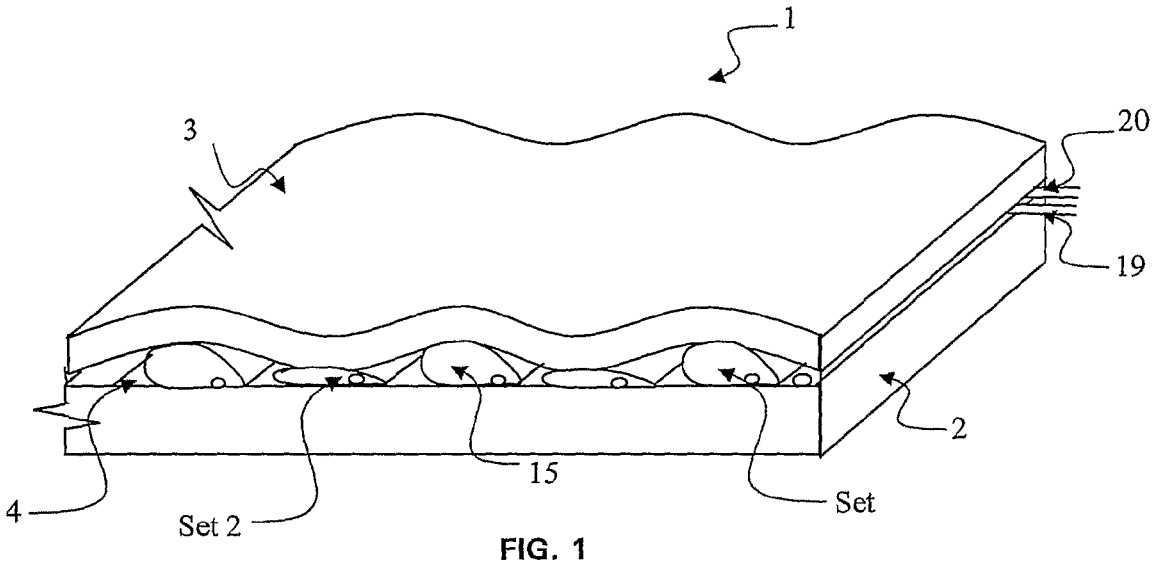
FIG. 1 is a perspective view of an alternating pressure mattress in accordance with the invention.
Figure 2:
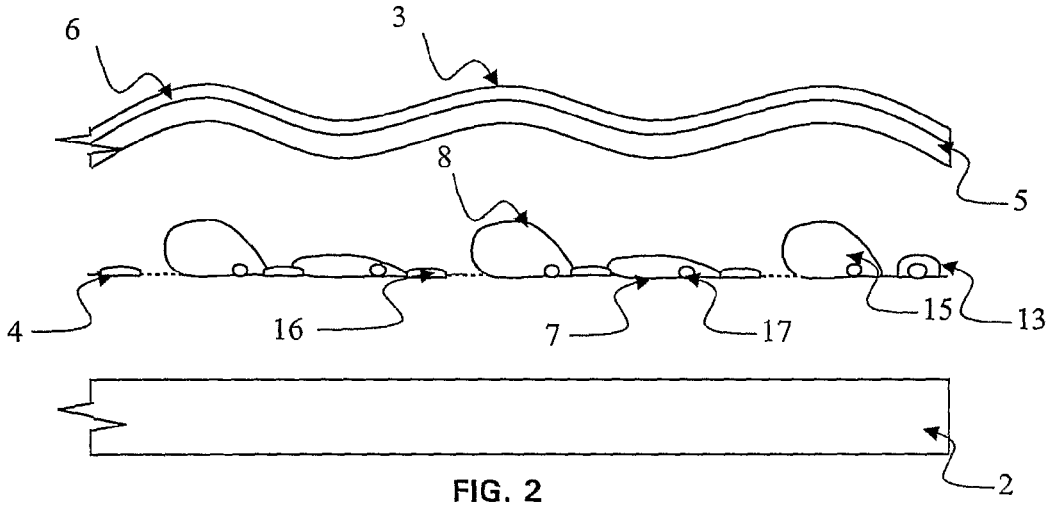
FIG. 2 is an exploded cross-sectional view of a similar alternating pressure mattress to that of FIG. 1.
Figure 3:
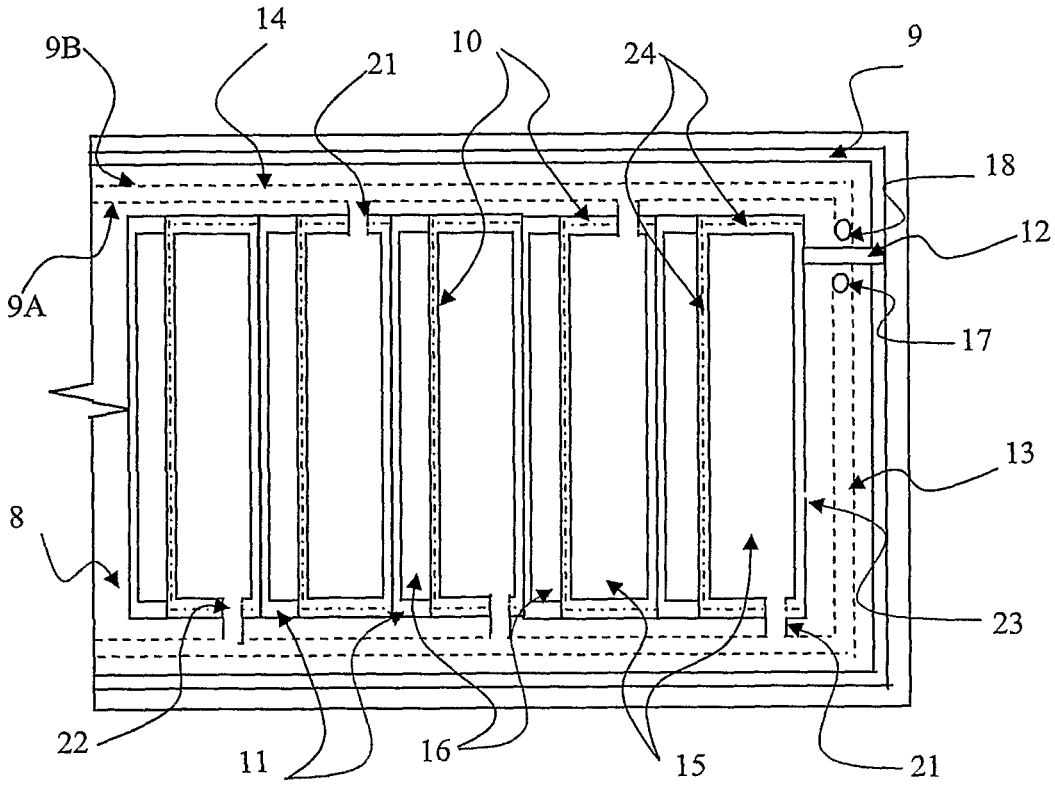
FIG. 3 is a plan view of an inflatable component for use in an alternating pressure mattress as in FIG. 1 or 2.

Referring to the drawings, an alternating pressure mattress 1 is generally rectangular in plan and has base 2, top 3 and inflatable 4 component enveloped in a cover (not shown), the inflatable component 4 being positioned between the base 2 and the top 3 components.

The base 2 is generally cuboidal and is firm relative to the top 3 in order to support the inflatable component 4 and the top 3 under the weight of a patient.

The top 3 is also generally cuboidal in shape, its plan view corresponding to that of the base 2. In one arrangement the top 3 is formed from a firm bottom layer 5 and a softer top layer 6, the bottom layer 5 comprising approximately two thirds of the overall thickness of the top 3.

The base and both layers of the top are formed from an expanded plastics foam material such as polyurethane foam.

The inflatable component 4 comprises two sheets of material, a base sheet 7 and a top sheet 8, of substantially the same size and rectangular shape, approximately corresponding to the size and shape of the base 2 and the top 3. The top sheet 8 is arranged above the base sheet 7 and the two sheets are sealed together along weld line 9 to provide a peripheral seal, the seal being provided by heat welding the two sheets 7, 8 together.

The two sheets are further joined together along weld lines 9*a* which together with the weld along the line 9 form two channels 13 and 14 each channel communicates with a respective inlet 17/18, and are separated by weld line 12. A strip of a hook type fastener material such as Velcro™ (or equivalent) 9*b* is disposed in channels 13 and 14 to hold the channels open if the mattress is bent, for example if a patient is sat up in bed.

The two sheets are further sealed together along lines 10 and 11 to define a plurality of individual cells 15 separated by compartments 16. Alternate cells 15 along the length of the component are connected respectively to channels 13 and 14 so that alternate cells 15 may be simultaneously inflated and deflated via inlets 17 and 18.

The two sheets 7, 8 are composed of a plastics sheet material, for example polyurethane or PVC.

The cells 15 are elongate and generally rectangular in shape, each one spanning substantially across the width of the component 4, the plurality of cells 15 being arranged alternately with elongate compartments 16 along the entire length of the component 4.

S Each cell 15 is held captive to the component 4 along a longitudinal edge 23, the remaining edges being free from the component 4. The edges are freed by cutting through the two sheets 7, 8 along lines 24.

The alternating pressure mattress can be used in a dynamic or conventional mode. In the conventional mode, air is allowed to escape from inlets 17 and 18 allowing the inflatable component to be substantially flat, with all cells 15 deflated.

In dynamic mode, an air supply is connected to inlets 17 and 18 via tubes 19 and 20 respectively, switched on and controlled such that air is pumped into tube 19 for a predetermined period of time, the air travelling along channel 13 to inflate the first set of cells 15 to result in an alternate arrangement of inflated/deflated cells 15 along the length of the component 4. The air supply is then shut off from tube 19, from which air is then allowed to escape to allow the first set of cells 15 to gradually deflate, whilst simultaneously supplying air into tube 20 for a predetermined period of time, to supply the second set of cells 15 with air, along channel 14, providing the opposite alternate arrangement of deflated/inflated cells 15. Once the air supply to the second set of cells 15 has been shut off, the first set of cells 15 are re-inflated, whilst the second set of cells gradually deflates and the process is continually repeated.

The above embodiment provides a low cost mattress that can be used in either a static or dynamic mode. The inflatable component can be used when required. The cost of the inflatable component is sufficiently low that the overall cost of the mattress is such that one could be provided for each bed in a hospital and an air supply connected when a dynamic mattress is required. The inflatable component could also be used as a mattress overlay and can be configured to be rapidly deflated to allow for CPR to be performed almost immediately on a patient when necessary.

It is of course to be understood that the invention is not intended to be restricted to the details of the above embodiment, which is described by way of example only.

What is claimed is:

1. An inflatable component for an alternating pressure mattress comprising:

a first layer and a second layer:

at least two inflatable cells, peripheral edges of each of the inflatable cells defined by the first layer being joined together with the second layer, each cell having at least two opposite short peripheral edges, at least one long peripheral edge being affixed to the component, and at least one long peripheral edge being a free peripheral edge from the component, and all or part of the short peripheral edges being free edges from the component; and wherein when a first cell inflates a second cell deflates creating varying high and low contact pressure on a part of a body of a user.

2. The inflatable component of claim 1, wherein the first layer and the second layer are joined together along predetermined lines to define the peripheral edges of the inflatable cells.

3. The inflatable component of claim 1, wherein the cells are elongate in shape spanning the width of the component and are arranged laterally along at least a proportion of the length of the component.

4. The inflatable component of claim 1, wherein the free edges of each cell comprise at least substantially all of one of its two opposite peripheral edges, with the remaining opposite peripheral edge being attached to the remainder of the component.

5. The inflatable component of claim 1, wherein the opposite peripheral edges of each cell are substantially parallel.

6. The inflatable component of claim 1, wherein each cell is substantially rectangular with one long peripheral edge being a free edge, and all or part of the short peripheral edges being free edges.

7. The inflatable component of claim 1, wherein the cells are arranged side by side.

8. The inflatable component of claim 7, wherein the cells are interspersed with strips of material.

9. The inflatable component of claim 1, wherein the component comprises at least two alternating groups of at least two cells, the cells of each group being connected to a common air inlet to allow for simultaneous inflation or deflation of the group of cells.

10. The inflatable component of claim 9, wherein cells forming two groups alternate along the length of the component.

11. The inflatable component of claim 9, further comprising air conduits leading to each cell or group of cells.

12. The inflatable component of claim 11, wherein a first conduit having an air inlet extends along one lateral edge of the component, communicating with each cell from one group of cells and a second conduit having an air inlet extends along the opposite lateral edge of the component and communicates with each cell from the other group of cells.

13. The inflatable component of claim 11, wherein a material is located within air conduits to facilitate a passage of air therethrough.

14. The inflatable component of claim 13, wherein the material is a strip of hook type fasteners.

15. The inflatable component of claim 1, further comprising:

a layer of supportive material.

16. The inflatable component of claim 1, wherein the at least two inflatable cells are disposed between the first and second layers.

17. The mattress of claim 16, wherein the inflatable component is disposed between a relatively firm layer of material intended to lie underneath the inflatable component while in use and a composite layer of material intended to lie over the inflatable component while in use, the composite layer of material comprising a layer of relatively firm material and a layer of relatively soft material, the relatively firm layer being disposed towards the inflatable component and the relatively soft layer being disposed away from the inflatable component.

18. A method for making an inflatable component for an alternating pressure mattress, the method comprising:

providing two layers of material;

joining the two layers of material together along predetermined lines to define a plurality of individual inflatable cells, each cell having at least two short opposite peripheral edges, and at least two long peripheral edges, a plurality of peripheral edges of each of the inflatable cells defined by the two layers of material being joined together; and cutting through the two layers of material along at least a part of the two short opposite peripheral edges and along one long peripheral edge of each cell to provide each cell with at least one long peripheral edge being a free edge from the component, and all or part of the short peripheral edges being free edges from the component.

19. The method of claim 18, wherein the two layers of material are joined by adhesive, heat welding or RF welding.

* * * * *